United States Patent [19]

Bertelli

[11] Patent Number: 4,767,013

[45] Date of Patent: Aug. 30, 1988

[54] SWIVEL CURTAIN ROD

[76] Inventor: Mariette R. Bertelli, 16 Oak St., Great Barrington, Mass. 01230

[21] Appl. No.: 937,054

[22] Filed: Dec. 2, 1986

[51] Int. Cl.[4] ..... A47H 1/10

[52] U.S. Cl. ..... 211/96; 211/105.1; 248/265

[58] Field of Search ..... 248/251, 252, 254, 261, 248/262, 264, 265, 289.1, 289.3, 291; 160/330, 335, 337, 340, 341; 211/105.1, 110, 193, 168, 96

[56] References Cited

U.S. PATENT DOCUMENTS

| | | | |
|---|---|---|---|
| 302,060 | 7/1884 | Vaas | 248/265 |
| 764,774 | 7/1904 | Sargeant | 248/289.1 |
| 1,078,822 | 11/1913 | Bond | 248/262 |
| 1,109,860 | 9/1914 | Molyneux | 248/265 |
| 1,147,944 | 7/1915 | Holdensen | 248/265 |
| 1,281,023 | 10/1918 | Kirsch . | |
| 1,291,307 | 1/1919 | Weber | 248/265 |
| 1,309,348 | 7/1919 | Boye . | |
| 1,572,845 | 2/1926 | Efford | 160/337 |
| 1,776,631 | 12/1928 | Lee . | |
| 1,956,799 | 5/1934 | Jessen | 248/289.1 |
| 2,192,882 | 3/1940 | DeMuth | 160/335 |
| 2,201,787 | 5/1940 | Peckham | 248/265 |
| 2,243,724 | 5/1941 | Whitehead | 248/265 |
| 2,296,323 | 9/1942 | Allen | 248/265 |
| 2,683,891 | 7/1954 | Rosenbaum . | |
| 2,766,892 | 10/1956 | Graber | 248/265 |
| 3,175,243 | 3/1965 | Weber . | |

FOREIGN PATENT DOCUMENTS

| | | | |
|---|---|---|---|
| 356454 | 2/1938 | Italy | 248/289.1 |
| 454078 | 1/1950 | Italy | 248/289.1 |
| 3749 | of 1905 | United Kingdom | 160/335 |

*Primary Examiner*—J. Franklin Foss
*Assistant Examiner*—Robert A. Olson
*Attorney, Agent, or Firm*—Banner, Birch, McKie & Beckett

[57] ABSTRACT

A swivel curtain rod is disclosed comprising a longitudinal curtain supporting member pivotally attached to a bracket that is mountable to a wall or window. The bracket contains a slot into which one end of the curtain supporting member passes. At this end of the curtain supporting member are disposed a plurality of vertically extending projections which are received into corresponding recesses in the bracket to pivotally mount the curtain supporting member to the bracket. The bracket comprises a three piece construction. Identical upper and lower supporting portions are mounted to a base portion. The slot is formed between the two supporting portions. A sliding finial is attached to the curtain supporting member to secure the curtains thereto. A pin extends through the finial and into a longitudinal track in the curtain supporting member to prevent the finial from rotating while allowing it to freely move along the curtain supporting member.

1 Claim, 1 Drawing Sheet

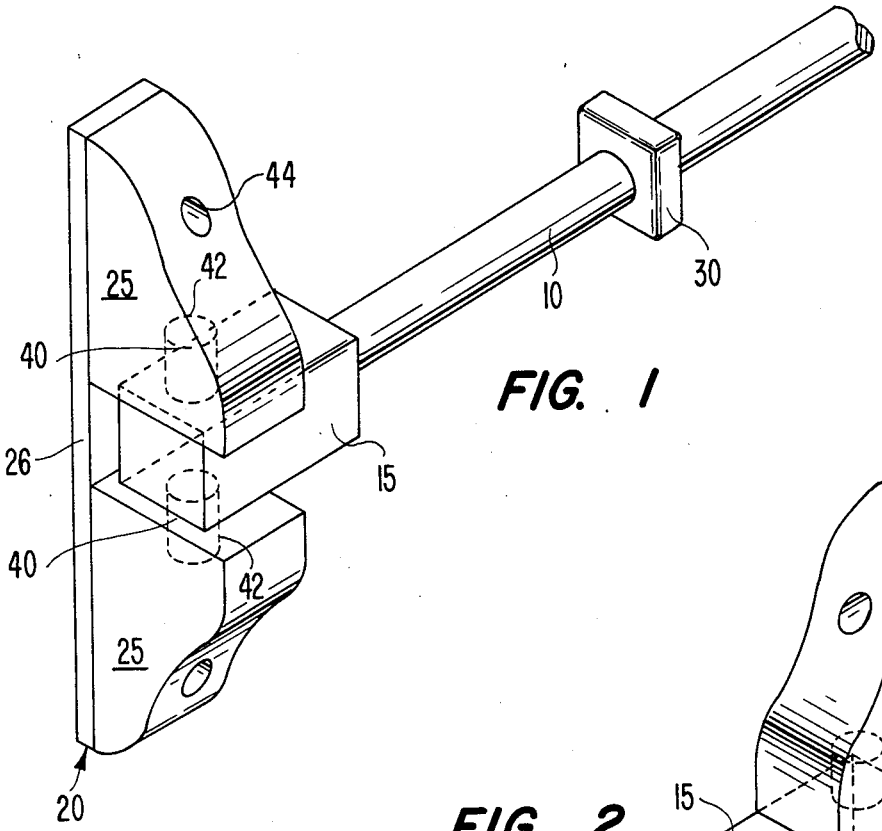
FIG. 1
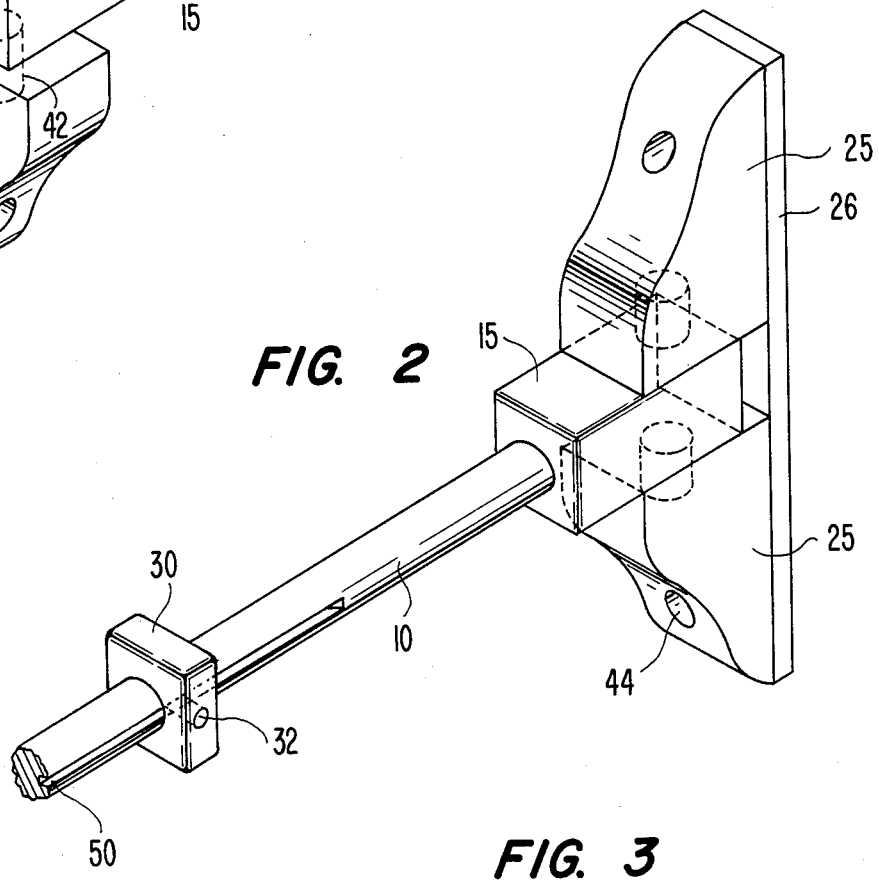
FIG. 2
FIG. 3
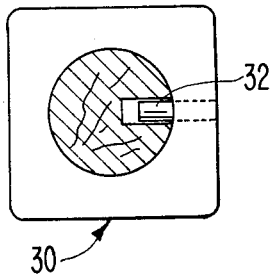

SWIVEL CURTAIN ROD

BACKGROUND OF THE INVENTION

This invention relates to curtain rods and more particularly, to an improved hinge and finial structure for a swivel curtain rod.

Moveable curtain rods, in general, have been used for many years and afford several advantages over standard fixed curtain rods. Moveable curtain rods allow the curtains to be moved away from the window allowing more natural light to enter a room. Moveable curtain rods also allow easy access to the windows, which facilitates cleaning. Fixed curtains rods must usually be removed before windows can be thoroughly cleaned.

U.S. Pat. No. 1,291,307 to Webber is generally illustrative of a swivel type curtain rod. Webber discloses an L-shaped curtain rod which is pivotally attached to a window frame. The rod and attached curtains may be swung away from the window. Similarly, U.S. Pat. No. 1,776,631 to Lee doiscloses a swivel curtain rod that is pivotally attached to a mounted wall bracket by means of a pin. The pin is inserted through holes in the bracket and passes through the curtain rod.

SUMMARY OF THE INVENTION

It is the principle object of the present invention to provide an improved swivel curtain rod that is easy to manufacture and install.

An important object of this invention is to provide a swivel curtain rod with a unique hinge structure.

The curtain rod according to the present invention comprises a longitudinal curtain supporting member pivotally attached to a bracket that is mountable to a wall or window. The bracket contains a slot into which one end of the curtain supporting member passes. At this end of the curtain supporting member are disposed a plurality of vertically extending projections which are received into corresponding recesses in the bracket ot pivotally mount the curtain supporting member to the bracket. The bracket comprises a three piece construction. Identical upper and lower supporting portions are mounted to a base portion. The slot is formed between the two supporting portions. A sliding finial is attached to the curtain supporting member to secure the curtains thereto. A pin extends through the finial and into a longitudinal track in the curtain supporting member to prevent the finial from rotating while allowing it to freely move along the curtain supporting member.

BRIEF DESCRIPTION OF THE DRAWINGS

The foregoing objects, as well as other, will become apparent through consideraiton of the following detailed description of the invention given in connection with the accompanying drawings in which:

FIG. 1 shows a curtain rod and hinge structure according to the present invention.

FIG. 2 shows the embodiment of FIG. 1 with a curtain rod in a second position.

FIG. 3 shows a front view of a sliding finial shown in FIG. 2.

DETAILED DESCRIPTION OF A PREFERRED EMBODIMENT

The curtain rod according to the present invention is shown in FIG. 1. The curtain rod comprises a longitudinal curtain supporting member 10 to which the curtain will be attached. Member 10 is attached at one end to rectangular connecting member 15, which is pivotally attached to bracket 20. Bracket 20 comprises two identical supporting portions 25, base plate 26, and may be mounted to a window frame, wall or other vertical supporting surface (not shown) by appropriate screws inserted through screw holes 44.

Connecting member 15 is pivotally mounted to bracket 20 by means of cylindrical projections 40 that extend from the upper and lower face of portion 15. Each cylindrical projection is received within a corresponding recess 42 within each supporting portion 25. Cylindrical projections 40 fit securely into each recess 42 but are loose enough to allow pivotal movement of the connecting member 15 and curtain supporting member 10.

A sliding finial 30 is attached to longitudinal member 10 and will prevent the curtain from slipping off of member 10. As can be seen in FIG. 2, inserted into the back portion of finial 30 is a pin 32. Pin 32 projects into a groove 50 running along member 10. In this manner finial 30 will not rotate, but will be free to move along curtain supporting member 10. FIG. 3 shows a front view of finial 30.

The unique hinge structure of the present invention provides a curtain rod that is both simple to manufacture and easy to install. Curtains may be easily moved away from the window to allow in more natural light or to facilitate cleaning. FIG. 2 shows a curtain rod that has been pivoted 90° with respect to the curtain rod depicted in FIG. 1.

Whereas the preferred embodiment has been illustrated and described as illustrative of the invention herein, it is to be understood that the swivel curtain rod of the invention herein shown and described must be taken only as a preferred representation of the invention. For example, base plate 26 can be eliminated and supporting portions 25 can be directly mounted to the wall or window. The device can be produced of any suitable material, including wood and can be produced in any desired size. Accordingly, various changes and modifications may be made without departing from the disclosure of the invention or the scope of the appended claims.

I claim:

1. A swivel rod comprising:

a longitudinal curtain supporting member, said curtain supporting member having a longitudinal groove therein;

a connecting member fixed to one end of said curtain supporting member, said connecting member having an upper face and a lower face;

a pivot projection fixed to and extending from each of said upper and lower faces of said connecting member;

a single bracket member, said bracket member having upper and lower spaced supports, said upper and lower supports having a pivot recess for receiving said pivot projections fixed to said upper and lower faces of said connecting membr, respectively;

said connecting member pivotably mounted to said bracket member so that said pivot projections are pivotably fixed in said pivot recesses of said upper and lower spaced supports thereby permitting said longitudinal curtain supporting member to pivot with respect to said bracket member; and a finial slidably attached to aid curtain supporting member for preventing a curtain from sliding off said curtan supporting member and for selectively positioning a curtain along said curtai supporting member, said finial having a pin extending through the surface of said finial and into said longitudinal groove in said curtain supporting member, said pin thereby preventing rotational movement of said finial with respect to said curtain supporting member.

* * * * *